US007805778B2

(12) United States Patent
Liao

(10) Patent No.: US 7,805,778 B2
(45) Date of Patent: Oct. 5, 2010

(54) STOOL FLUSHING DEVICE HAVING CONTROL SWITCH AND LOCKING ASSEMBLY

(75) Inventor: Yu-Chang Liao, Taichung (TW)

(73) Assignee: Song Yang Ltd., Co, Taichung (TW)

( * ) Notice: Subject to any disclaimer, the term of this patent is extended or adjusted under 35 U.S.C. 154(b) by 646 days.

(21) Appl. No.: 11/845,782

(22) Filed: Aug. 28, 2007

(65) Prior Publication Data

US 2009/0056005 A1 Mar. 5, 2009

(51) Int. Cl.
*E03D 5/10* (2006.01)
*E03D 9/08* (2006.01)

(52) U.S. Cl. ..... 4/406; 4/448; 4/420.4

(58) Field of Classification Search ..... 4/406, 4/420, 420.4, 420.5, 447, 448
See application file for complete search history.

(56) References Cited

U.S. PATENT DOCUMENTS 3,810,602 A * 5/1974 Parkinson ..... 251/304
3,987,819 A * 10/1976 Scheuermann ..... 137/637.3
4,642,820 A * 2/1987 Boring, Jr. ..... 4/420.4
4,761,836 A * 8/1988 Tsutsui et al. ..... 4/420.2
5,014,784 A * 5/1991 Shen ..... 166/272.3
5,452,483 A * 9/1995 Dizon, Jr. ..... 4/420.4
6,357,479 B1 * 3/2002 Wagner et al. ..... 137/625.21
6,681,411 B1 * 1/2004 Wu et al. ..... 4/420.4
6,854,658 B1 * 2/2005 Houghton et al. ..... 236/12.12
6,941,590 B2 * 9/2005 Lim ..... 4/420.4
7,065,802 B2 * 6/2006 Jung ..... 4/420.2
2003/0163864 A1 * 9/2003 Haan ..... 4/420.4
2006/0253967 A1 * 11/2006 Wu ..... 4/420.4
2008/0201836 A1 * 8/2008 Yao ..... 4/420.4

* cited by examiner

*Primary Examiner*—Khoa D Huynh

(57) ABSTRACT

A stool flushing device having a control switch and a locking assembly comprises: a casing having a receiving space therein; the casing having an inlet which can be connected to a water source; the inlet being communicated to the receiving space; the casing having a first outlet and a second outlet; a rotary button being a disk like structure; an axial rod being connected to a lower center of the rotary button; a control portion separating the receiving space; the control portion including an upper disk, a valve disk and a lower disk; the upper disk being formed with a first injection opening and a second injection opening; the first injection opening being communicated to the first outlet and the second injection opening being communicated to the second outlet; the lower disk having a third injection opening and a fourth injection opening.

1 Claim, 10 Drawing Sheets

STOOL FLUSHING DEVICE HAVING CONTROL SWITCH AND LOCKING ASSEMBLY

FIELD OF THE INVENTION

The present invention relates to stool flushing devices, and particularly to a stool flushing device having a control switch and a locking assembly, wherein no electric power is necessary and the water output can be controlled with different stages.

BACKGROUND OF THE INVENTION

In the prior art stool, only one water outlet is designed for providing flushing water into the stool. Thus, only one control switch is installed. However in some improved stools, the stool has a plurality of water outlets, and each water outlet has a dedicate control switch. As a result, the cost is high and further the operation is inconvenient.

Furthermore, some control switches are electronic switches, in that, the pressure from the rotary button will induce a circuit so as to control the water amount to be outputted. However this kind of switch is expensive and the lifetime is short.

Furthermore, the prior art flushing device is designed for a specific stool and the flushing device will cause that the cushion cannot tightly adhere an upper surface of the stool. With referring to FIG. 14, duet to the installation of the flushing device 90, the cushion 91 can not tightly adhere upon the upper surface of the stool, even a great gap generates therebetween. As a result, it is possible to hurt the user or the cushion will break.

SUMMARY OF THE INVENTION

Accordingly, the primary object of the present invention is to provide a stool flushing device having a control switch and a locking assembly, wherein no electric power is necessary and the water output can be controlled with different stages.

To achieve above objects, the present invention provides a stool flushing device having a control switch and a locking assembly comprising: a casing having a receiving space therein; the casing having an inlet which can be connected to a water source; the inlet being communicated to the receiving space; the casing having a first outlet and a second outlet; the first outlet and second outlet being communicated to the receiving space; a rotary button being a disk like structure; a block protrudes from an upper surface of the rotary button; the rotary button being pivoted to the upper casing; an axial rod passing through the axial hole of the upper casing to be connected to a lower center of the rotary button so that the axial rod is driven by the rotary button as the rotary button is the rotated; a control portion separating the receiving space so that the inlet can not communicate to the first outlet and second outlet; the control portion includes an upper disk, a valve disk and a lower disk; the upper disk being formed with a first injection opening and a second injection opening; the first injection opening being communicated to the first outlet and the second injection opening being communicated to the second outlet; the lower disk having a third injection opening and a fourth injection opening; the position of the third injection opening being corresponding to that of the first injection opening; the position of the fourth injection opening is corresponding to that of the second injection opening; and the valve disk of the control portion having at least one guide hole; a center of the control portion having an embedding groove for receiving a lower end of the axial rod.

By the rotary button to drive the axial rod and thus drive the valve disk of the control portion, the guide hole will overlap with the first injection opening and the third injection opening or overlap with the second injection opening and the fourth injection opening. When the guide hole overlaps with the first injection opening and the third injection opening, water flows into the inlet to the first injection opening and then to the first outlet. When the guide hole overlaps with the second injection opening and fourth injection opening, water flows into the inlet to the second outlet; otherwise, when the guide hole do not overlap with any injection hole, the structure is closed and thus no water flows.

The various objects and advantages of the present invention will be more readily understood from the following detailed description when read in conjunction with the appended drawing.

BRIEF DESCRIPTION OF THE DRAWINGS

FIGS. 1-1 and 1-2 show the upper casing of the stool flushing device having a control switch and a locking assembly, which are illustrated from another views.

FIG. 2 is an assembled view of the stool flushing device having a control switch and a locking assembly of the present invention.

FIG. 4-1 is a cross sectional view about the close state of the stool flushing device of the present invention.

FIG. 4-2 is an elevation view of the stool flushing device having a control switch and a locking assembly of the present invention.

FIG. 5-1 is a schematic cross sectional view showing the open state of the second outlet of the present invention.

FIG. 5-2 is an elevation view of FIG. 5-1

FIG. 6-1 is a schematic cross sectional view showing the open state of the first outlet of the present invention.

FIG. 6-2 is an elevation view of FIG. 6-1.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
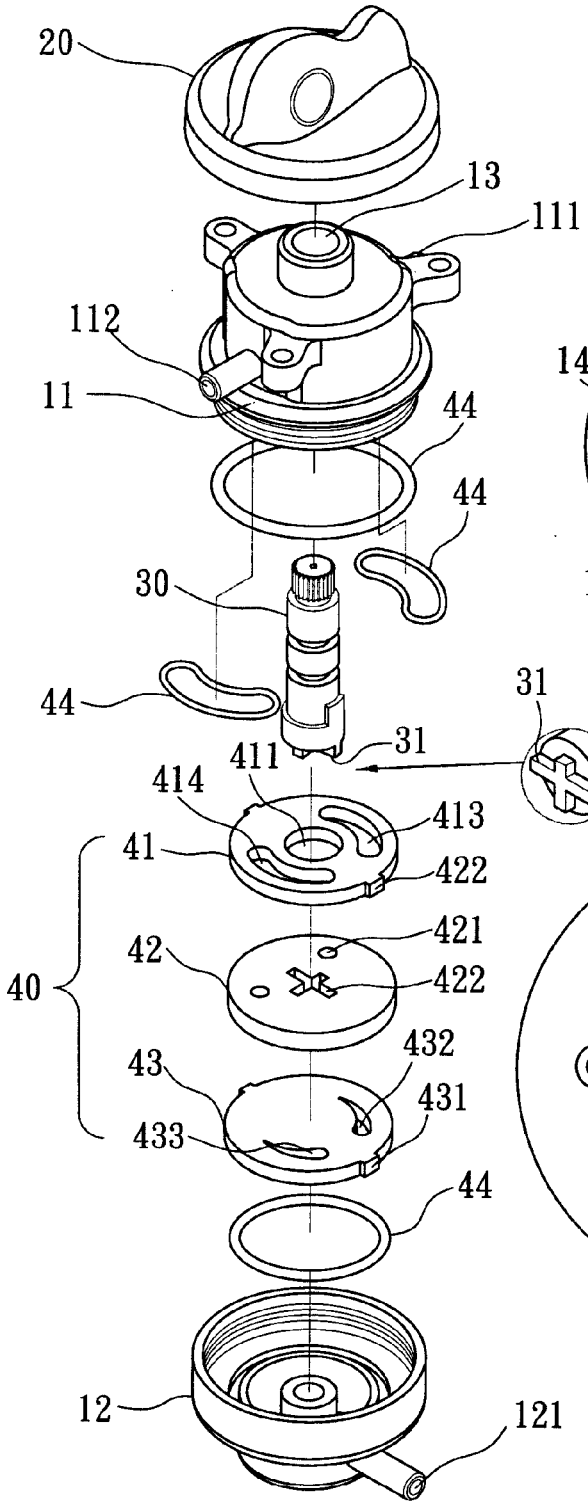
FIG. 1 is an exploded perspective view of the stool flushing device of the present invention.
Figure 1:
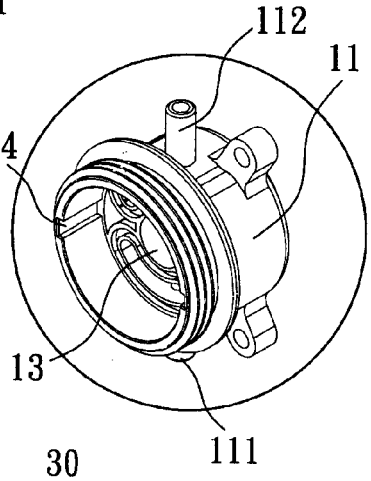
Figures 1, 2:
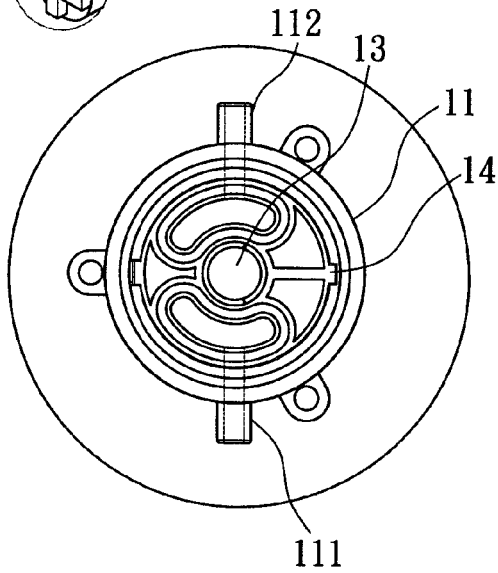
Figure 2:
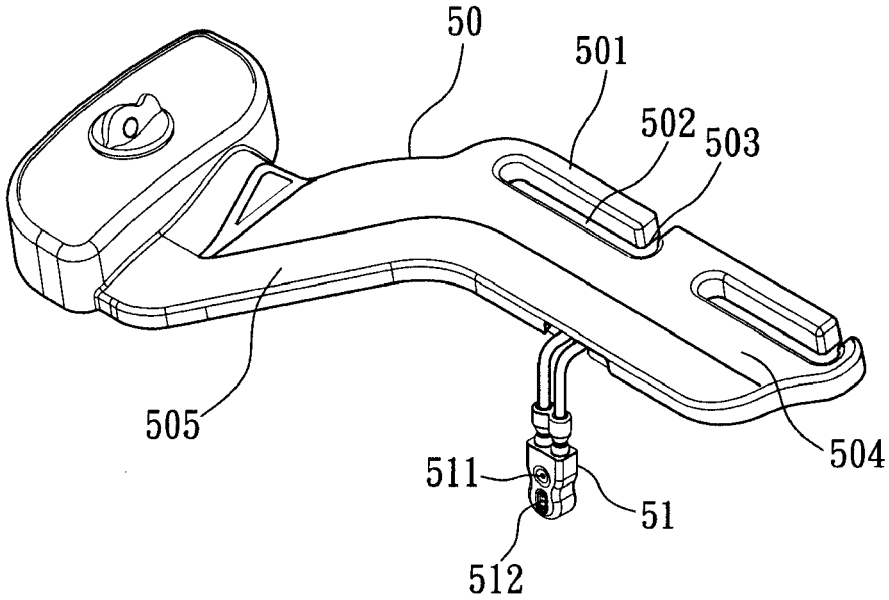
Figure 3:
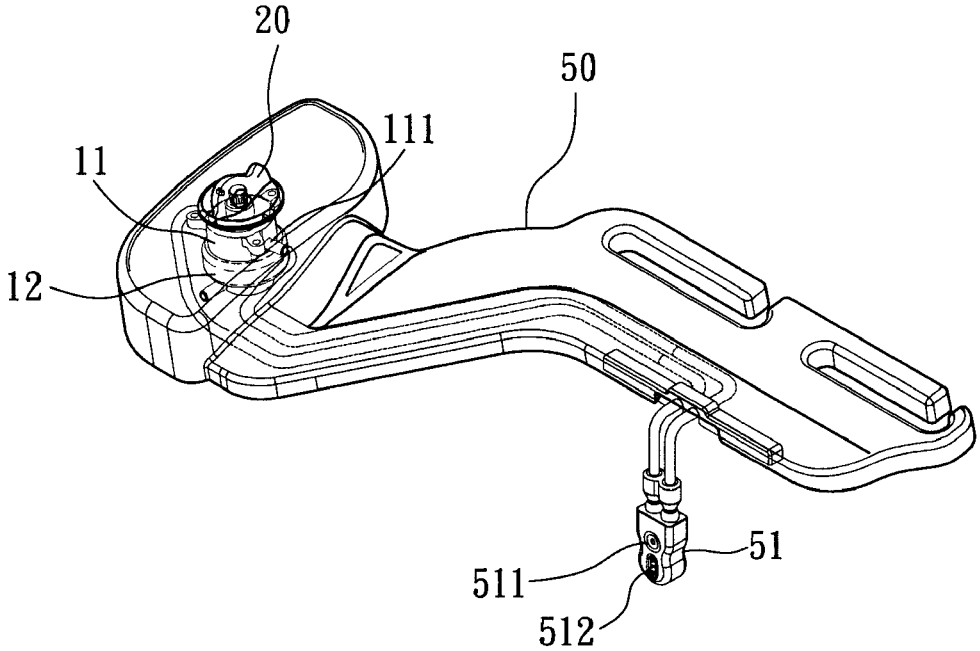
FIG. 3 is a schematic perspective view about the assembly of the stool flushing device according to the present invention.
Figures 1, 4:
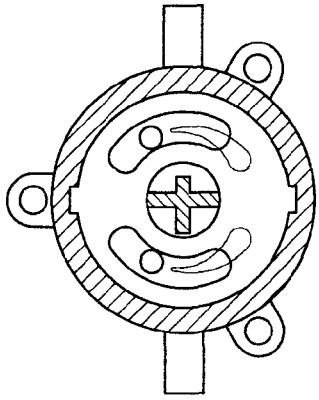
Figures 2, 4:
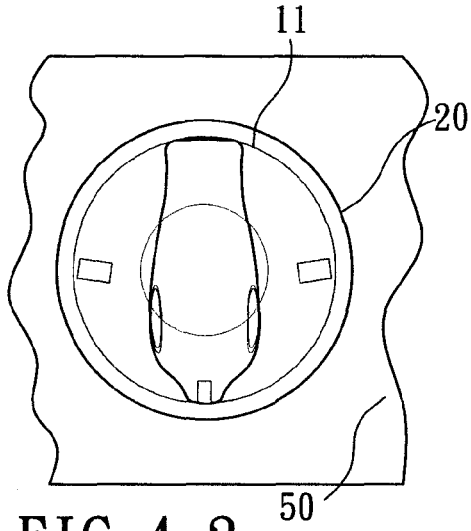
Figures 1, 5:
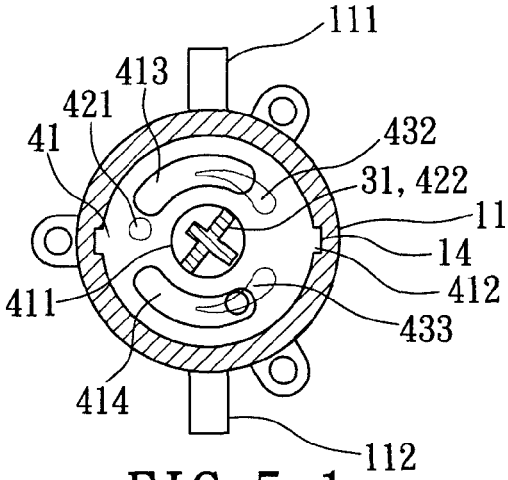
Figures 2, 5:
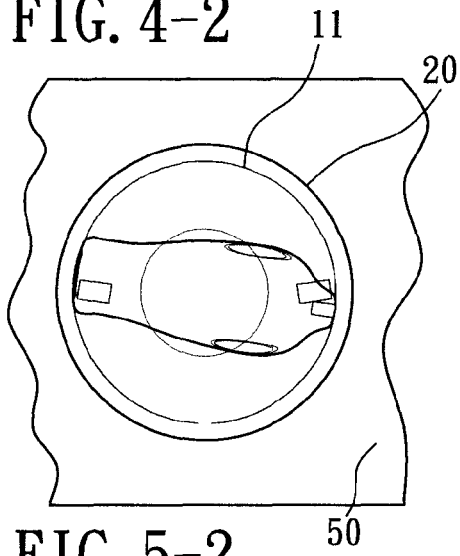
Figures 1, 6:
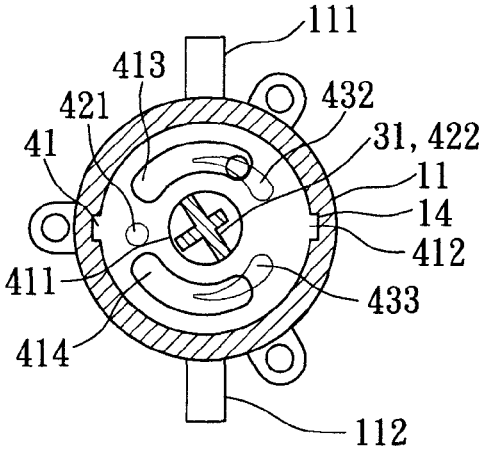
Figures 2, 6:
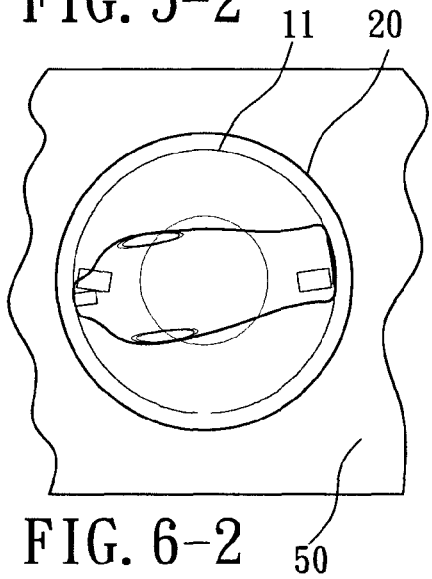
Figure 7:
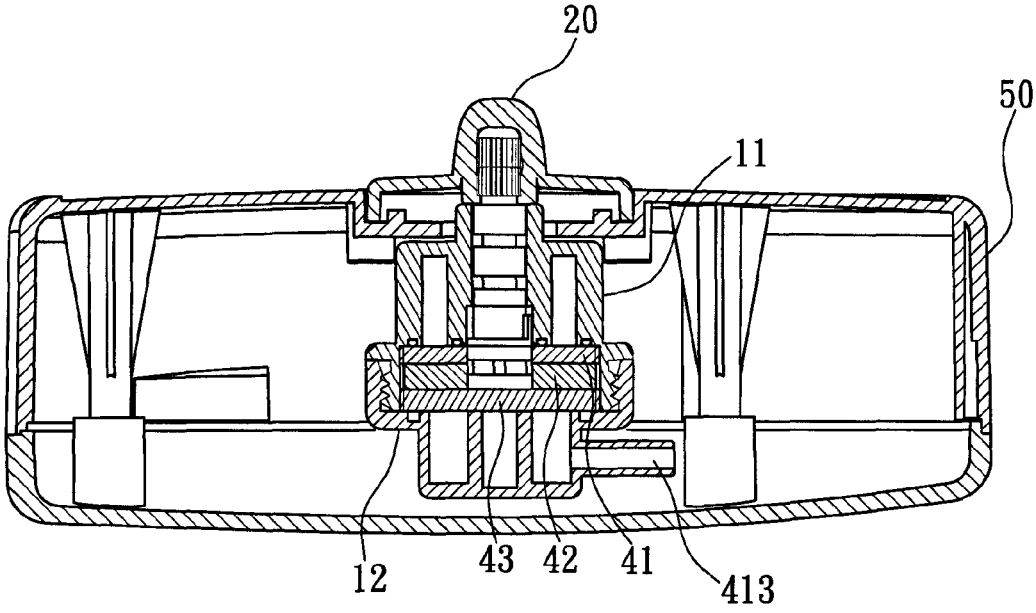
FIG. 7 is a schematic cross sectional view of FIG. 4-1.
Figure 8:
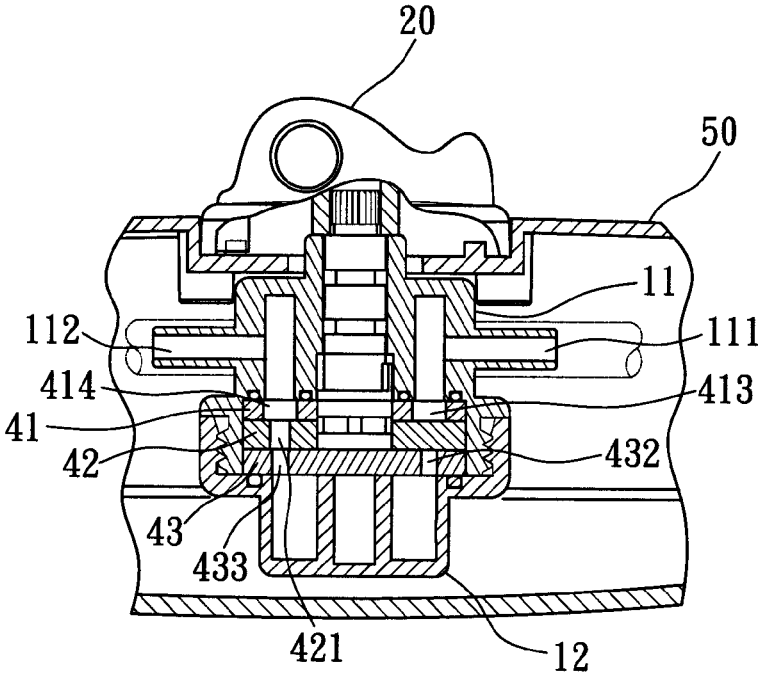
FIG. 8 is a schematic cross sectional view of FIG. 5-1.
Figure 9:
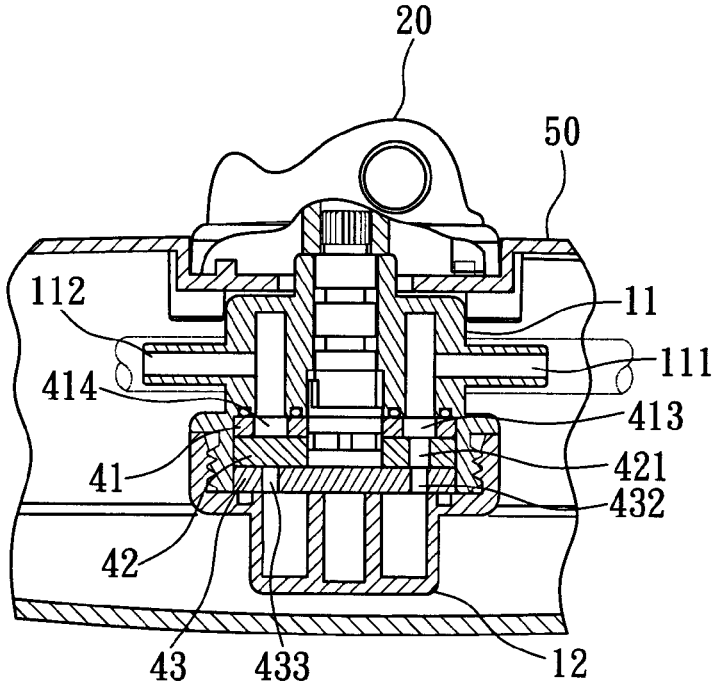
FIG. 9 is a schematic cross sectional view of FIG. 6-1.

Referring to FIGS. 1 to 3, the stool flushing device having a control switch and a locking assembly according to the present invention is illustrated. The control switch of the present invention is installed to a stool flushing device 50. The flushing device 50 has a plate like structure and has a locking portion 501. The locking portion 501 has a locking grooves 502 each has an L shape. One end of the L shape groove 502 has an opening 503 for being assembled to a stool. The flushing device 50 is installed with a supporting portion 503 which has an inclined surface 505 for adhesion. The locking portion 501 and the supporting portion 504 are made of plastics.

The present invention has the following elements.

An upper casing 11 and a lower casing 12 are included. With referring to FIGS. 1, 1-1 and 1-2, the upper casing 11 and lower casing 12 have threads for locking to one another. After assembly, a receiving space is formed between the upper casing 11 and lower casing 12.

The upper casing 11 has an inlet 121 which can be connected to a water source. The inlet 121 is communicated to the receiving space. The upper casing 11 has a first outlet 111 and a second outlet 112. The first outlet 111 and second outlet 112 are communicated to the receiving space. The first outlet 111 and the second outlet 112 can be connected to the water outputs 511, 512 of the water outlet portion 51. The upper casing 11 has an axial hole 13. An inner wall of the upper casing 11 is formed with two recesses 14.

A rotary button 20 has a disk like structure. A block protrudes from an upper surface of the rotary button 20. The user can drive the block for rotating the rotary button 20. The rotary button 20 is pivoted to the upper casing 11.

An axial rod 30 passes through the axial hole 13 of the upper casing 11 to be connected to a lower center of the rotary button 20 so that the axial rod 30 is driven by the rotary button 20 as the rotary button 20 rotates. A lower end of the axial rod 30 is formed with an engaging rib 31 which has a cruciform shape.

A control portion 40 serves to separate the receiving space so that the inlet 121 can not communicate to the first outlet 111 and second outlet 112. The control portion 40 includes an upper disk 41, a valve disk 42 and a lower disk 43. Waterproof washers 44 are installed between the upper casing 11 and the upper disk 41 and also installed between the lower casing 12 and the lower disk 43.

A center of the upper disk 41 has an opening 411. The axial rod 30 passes through the opening 411. A lateral side of the upper disk 41 has a rib 412 for being embedded into one of the recesses 14 of the upper casing 11 so that the upper disk 41 will not rotate with respect to the upper casing 11. An upper disk 41 is formed with a first injection opening 413 and a second injection opening 414. The first injection opening 413 is communicated to the first outlet 111 and the second injection opening 414 is communicated to the second outlet 112. An upper side of the first injection opening 413 is installed with a waterproof washer 44 and an upper side of the second injection opening 414 is installed with a waterproof washer 44. A lateral side of the lower disk 43 has a rib 431 which can be embedded into the recess 14 of the upper casing 11 so that the lower disk 43 is firmly secured to the lower casing 12 without rotation. The lower disk 43 has a third injection opening 432 and a fourth injection opening 432. Each of the third injection opening 432 and the fourth injection opening 432 has a shape with a larger end and a small end. The large end is gradually reduced to the small end. The position of the third injection opening 432 is corresponding to that of the first injection opening 413. The position of the fourth injection opening 432 is corresponding to that of the second injection opening 414.

The valve disk 42 of the control portion 40 has at least one guide hole 421. In this embodiment, two guide holes 421 are illustrated. A center of the control portion 40 has an embedding groove 422 for receiving a lower end of the axial rod 30.

Therefore, by the rotary button 20 to drive the axial rod 30 and thus drive the valve disk 42 of the control portion 40, the guide hole 421 will overlap with the first injection opening 413 and the third injection opening 432 or overlap with the second injection opening 414 and the fourth injection opening 432. When the guide hole 421 overlaps with the first injection opening 413 and the third injection opening 432, water flows into the inlet 121 to the first injection opening 413 and then to the first outlet 111. When the guide hole 421 overlaps with the second injection opening 414 and fourth injection opening 432, water flows into the inlet 121 to the second outlet 112. Otherwise, when the guide hole 421 does not overlap with any injection hole, the structure is closed and thus no water flows.

Referring to FIGS. 4 to 9, the operation of the present invention is illustrated.

Referring to FIGS. 4-1, 4-2 and 7, it is illustrated that the present invention is in a close state. When the guide hole 421 does not overlap with the first injection opening 413 and third injection opening 432 or overlaps with the second injection opening 414 and fourth injection opening 432, the inlet 121 isolates with the first outlet 111 and second outlet 112, no water flows.

Referring to FIGS. 5-1, 5-2 and 8, it is illustrated that when the rotary button 20 rotates counterclockwise, the guide hole 421 will overlap gradually with the second injection opening 414 and fourth injection opening 432, moreover, because that the fourth injection opening 432 has a reduced shape, the greater the rotation of the guide hole 421, the greater the overlapping area between the guide hole 421 and the fourth injection opening 432. Thus the amount of water flowing from the inlet 121 to the second outlet 112 becomes greater gradually.

With referring to FIGS. 6-1, 6-2 and 9, when the rotary button 20 rotates clockwise, the guide hole 421 will overlap gradually with the first injection opening 413 and third injection opening 432, moreover, because that the third injection opening 432 has a reduced shape, the greater the rotation of the guide hole 421, the greater the overlapping area between the guide hole 421 and the second injection opening 414. Thus the amount of water flowing from the inlet 121 to the first outlet 111 become greater gradually.

Thus, in the present invention, no electric device is used. A single control switch will control the water outlet with a lower cost.

Figure 10:
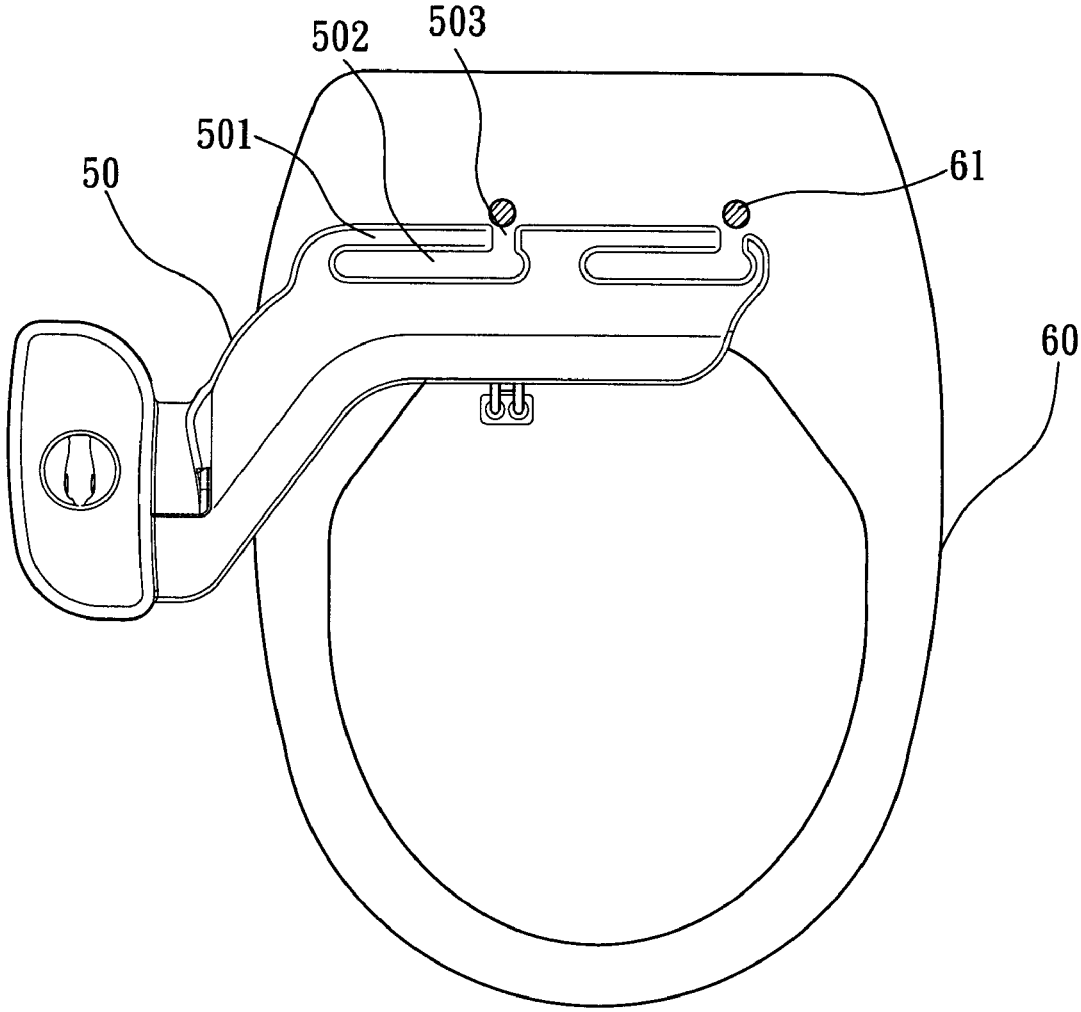
FIGS. 10 and 11 are assembled schematic views of the locking portion of the flushing device assembled to a stool.
Figure 11:
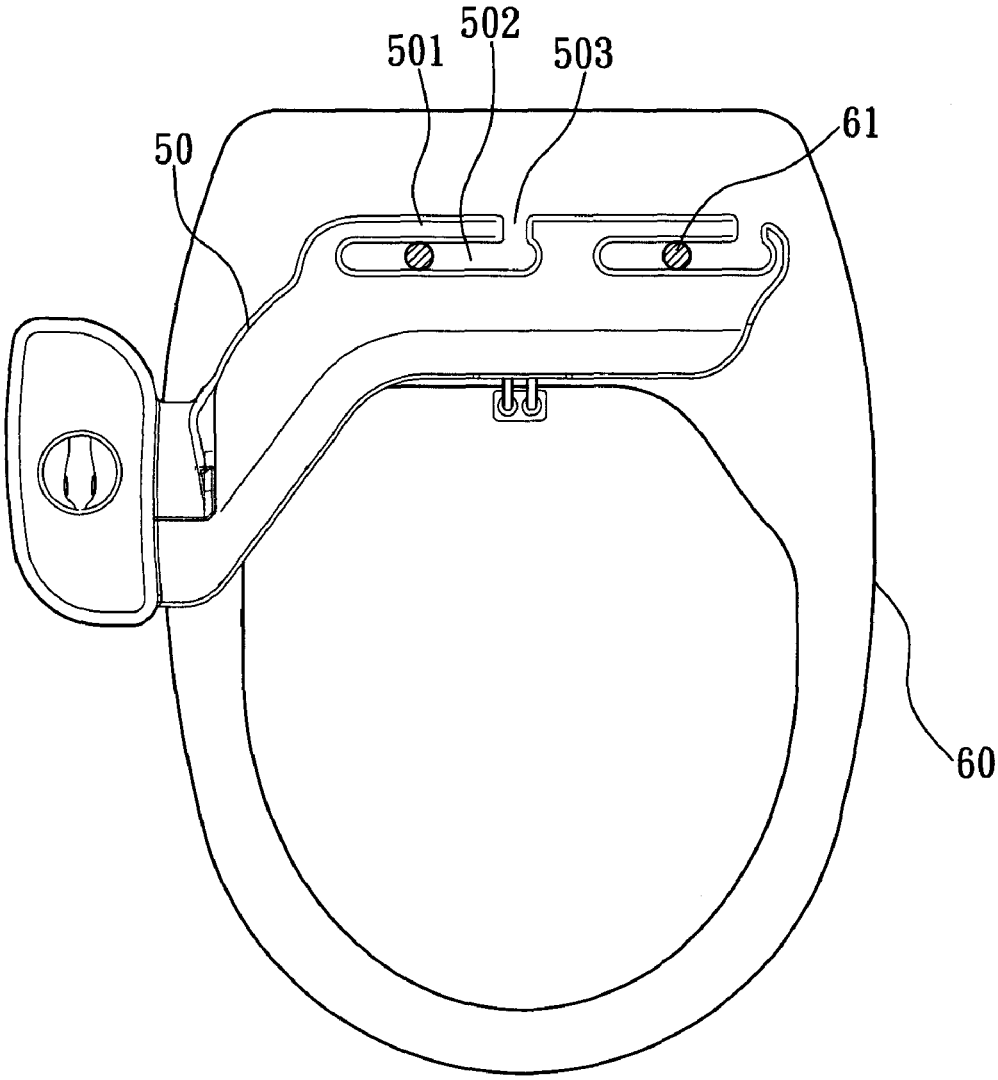
Figure 12:
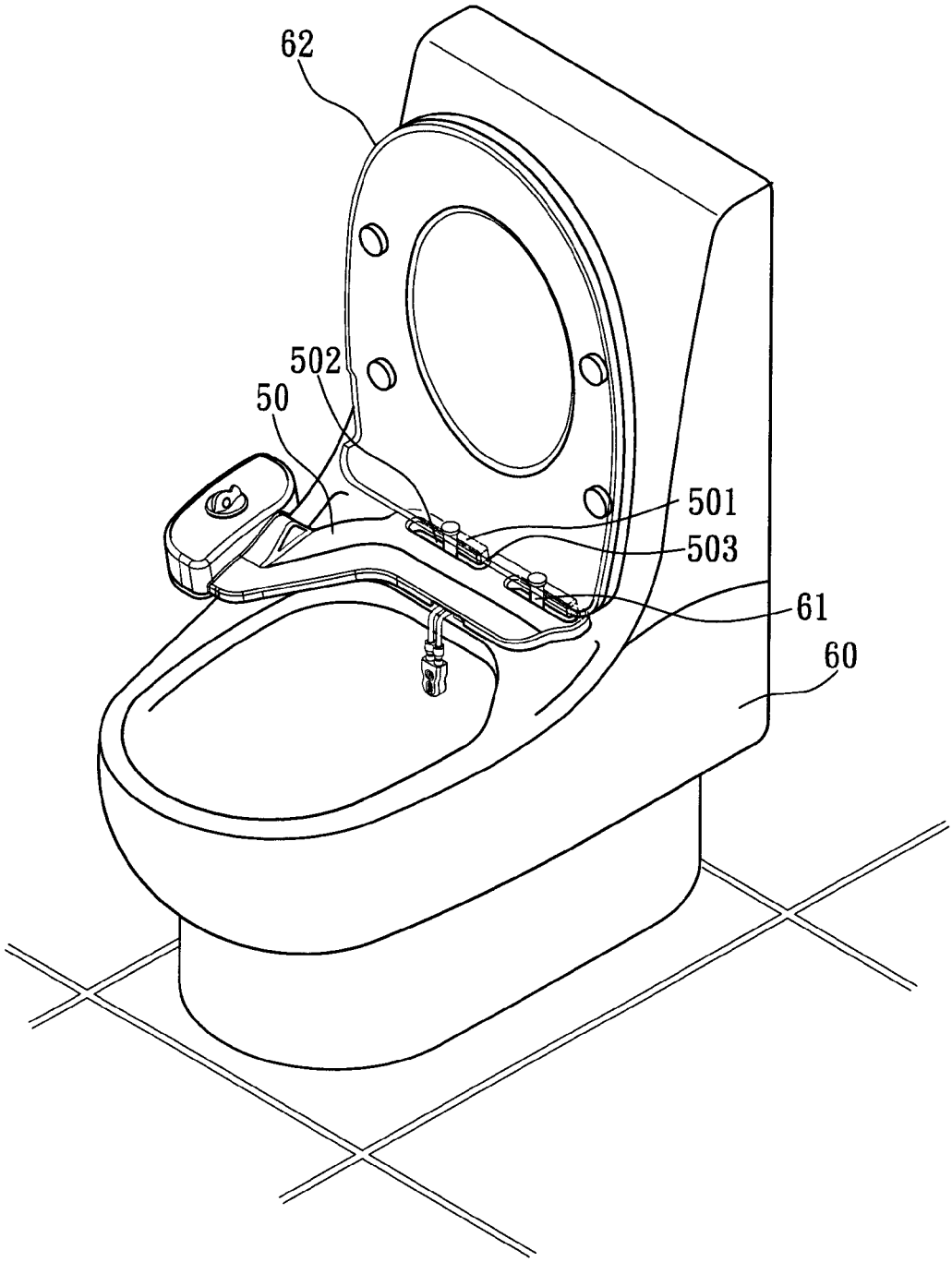
FIG. 12 is an assembled perspective view showing that that the locking portion of the flushing device is assembled to a stool.

Referring to FIGS. 10 and 12, it is illustrated that in the present invention, the flushing device 50 is locked to a stool by using a locking portion 501 and retainers 61. The retainers 61 are placed to the openings 503 of the flushing device 50. As shown in FIG. 12, the retainers 61 are placed into the locking grooves 502 which are then locked by screwing means or other elements so that the retainers 60 are locked integrally with the locking portion 501. Thus, the flushing device 50 can be easily installed to the stool 60 of various sizes.

Figure 13:
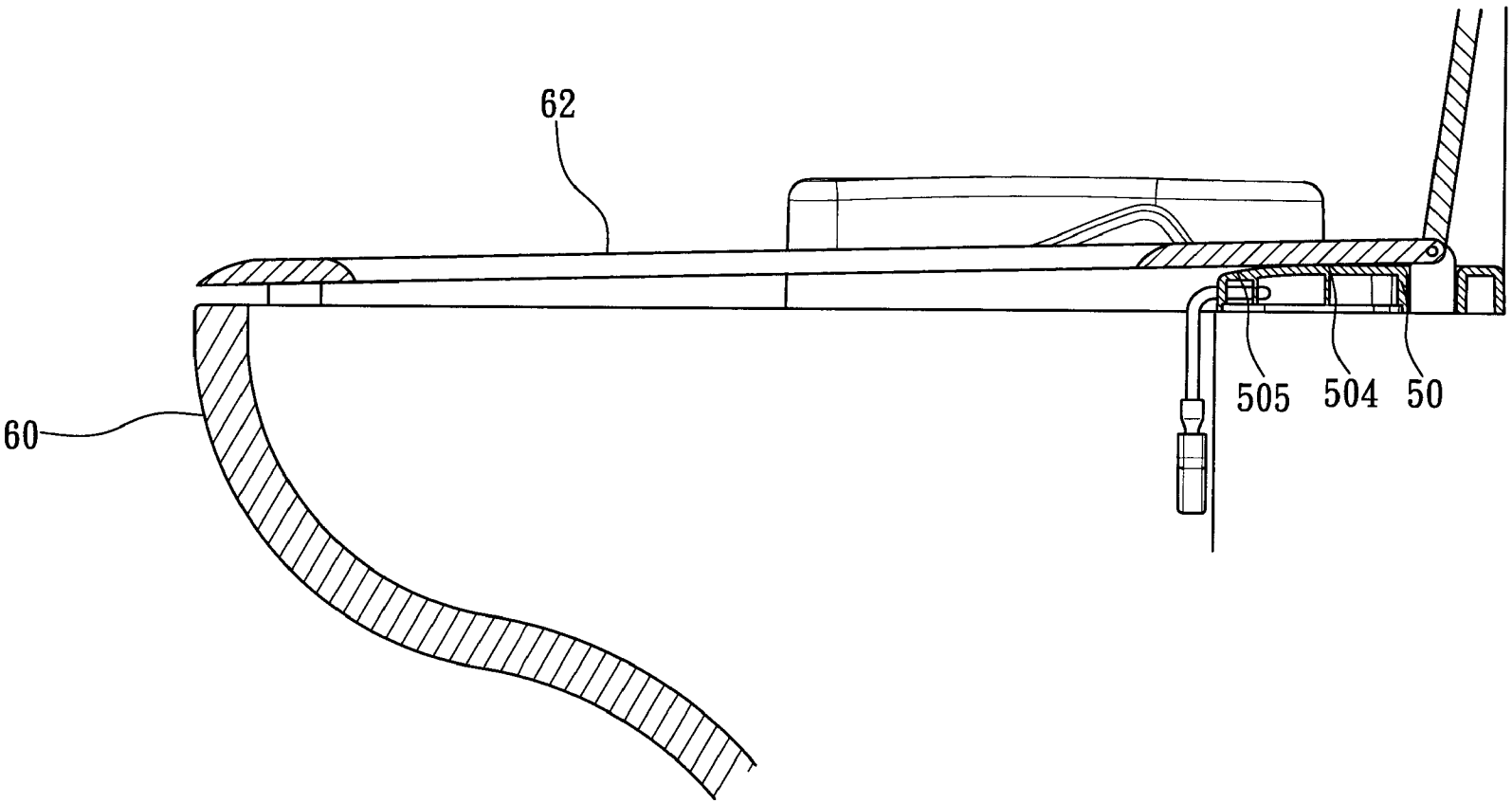
FIG. 13 is an assembled schematic cross sectional view showing that the supporting portion of the stool flushing device of the present invention is assembled to a stool.
Figure 14:
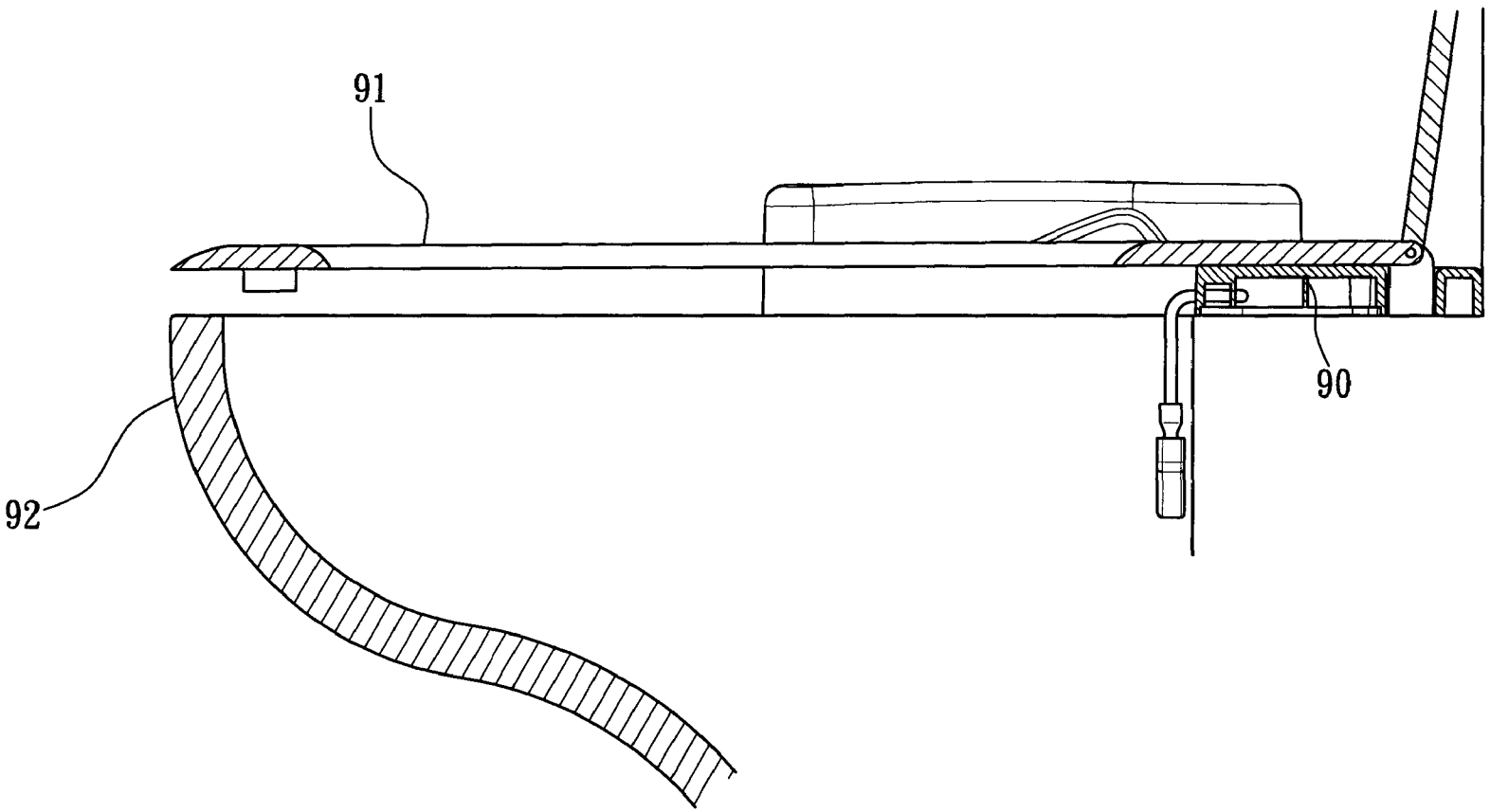
FIG. 14 is a schematic cross sectional view of a prior art structure.

Referring to FIG. 13, the flushing device 50 has a supporting portion 504 which has an inclined surface 505. The flushing device 50 is installed between the stool 60 and the seat or cushion 62. By the inclined surface 505, the flushing device 50 will not tightly adhere to the cushion 62 and thus the cushion 62 can be placed along the inclined surface 505 so that the cushion 62 is adhered to the stool without any gap therebetween so as to prevent from cracking or destroy.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A stool flushing device having a control switch and a locking assembly comprising:

a casing having a receiving space therein, wherein the casing is formed by an upper casing and a lower casing;

the casing having an inlet configured to be connected to a water source; the inlet being fluidly communicated to receiving space; the casing having a first outlet and a second outlet; the first outlet and second outlet being fluidly communicated to the receiving space;

a rotary button being a disk-like structure; a block protruding from an upper surface of the rotary button; the rotary button being pivoted to the upper casing;

an axial rod passing through an axial hole of the upper casing to be connected to a lower center of the rotary button so that the axial rod is driven by the rotary button as the rotary button is the rotated;

a control portion separating the receiving space so that the inlet can not communicate to the first outlet and second outlet; the control portion includes an upper disk, a valve disk and a lower disk, wherein a washer is installed between the upper disk and the casing and another washer is installed between the lower disk and the casing;

the upper disk being formed with a first injection opening and a second injection opening; the first injection opening being fluid communicated to the first outlet and the second injection opening being fluidly communicated to the second outlet, wherein a waterproof washer is installed in an upper side of the first injection opening and between the first injection opening and the upper casing, and another waterproof washer is installed in an upper side of the second injection opening and between the second injection opening and the upper casing, wherein the upper disk having lateral sides, wherein a center of the upper disk has an opening, and the axial rod passes through the opening;

the lower disk having a third injection opening and a fourth injection opening; the position of the third injection opening being corresponding to that of the first injection opening; the position of the fourth injection opening is corresponding to that of the second injection opening, wherein each of the third injection opening and the fourth injection opening has a shape with a larger end and small end; the large end is gradually reduced to the small end, wherein the lower disk having lateral sides; and the valve disk of the control portion having two guide holes; a center of the control portion having an embedding groove that receives a lower end of the axial rod; and wherein the rotation of the rotary button drives the axial rod and thus drives the valve disk of the control portion, the two guide holes then overlap with the first injection opening and the third injection opening or overlap with the second injection opening and the fourth injection opening; whereby when the two guide holes overlap with the first injection opening and the third injection opening, water flows into the inlet to the first injection opening and then to the first outlet; and when the two guide holes overlap with the second injection opening and fourth injection opening, water flows into the inlet to the second outlet; wherein when the two guide holes do not overlap with the injection holes, the device is closed and thus no water flows;

wherein an inner wall of the upper casing has recesses, each of the lateral sides of the upper disk and lower disk has a rib which engages to the recess of the upper casing so as to lock the upper disk and lower disk to the upper casing;

wherein a lower end of the axial rod is formed with an engaging rib which is received in the embedding groove of the valve disk;

wherein the flushing device has a plate-like structure with a locking portion; the locking portion has L-shaped locking grooves, one end of one of the L-shaped locking grooves has an opening, the openings allow retainers of a stool to enter into the L-shaped locking grooves so that the stool flushing device is installed onto and locked to the stool, wherein the locking portion is made of plastics;

wherein the stool flushing device further comprising a supporting portion which extends outwardly from the locking portion, the support portion has an inclined surface, wherein when the stool flushing device is installed between the stool and the seat, the stool flushing device is not tightly adhere to the seat due to the inclined surface such that when the seat is placed along the inclined surface, the seat is adhered to the stool without any gap therebetween, wherein the supporting portion is made of plastics.

* * * * *